US011668492B2

(12) United States Patent
Xiong et al.

(10) Patent No.: US 11,668,492 B2
(45) Date of Patent: Jun. 6, 2023

(54) HEAT EXCHANGER ASSEMBLY AND AIR CONDITIONER

(71) Applicant: Gree Electric Appliances, Inc. of Zhuhai, Guangdong (CN)

(72) Inventors: Jianguo Xiong, Guangdong (CN); Zhongmei Wei, Guangdong (CN); Xixi Kuang, Guangdong (CN); Quanyou Hu, Guangdong (CN); Weixue Lin, Guangdong (CN); Ge Yu, Guangdong (CN); Jian Ye, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 17/261,037

(22) PCT Filed: May 14, 2019

(86) PCT No.: PCT/CN2019/086862

§ 371 (c)(1),
(2) Date: Jan. 18, 2021

(87) PCT Pub. No.: WO2020/034677

PCT Pub. Date: Feb. 20, 2020

(65) Prior Publication Data

US 2021/0254858 A1 Aug. 19, 2021

(30) Foreign Application Priority Data

Aug. 17, 2018 (CN) ..... 201810941571.3

(51) Int. Cl.
*F24F 13/30* (2006.01)

(52) U.S. Cl.
CPC ..... *F24F 13/30* (2013.01)

(58) Field of Classification Search
CPC .. F24F 13/30; F24F 1/0063; F24F 1/16; F24F 1/0059; F24F 1/0067
See application file for complete search history.

(56) References Cited

U.S. PATENT DOCUMENTS 4,926,931 A * 5/1990 Larinoff ..... F28B 9/10 165/113
5,199,276 A * 4/1993 Sullivan ..... F24F 13/22 220/571

(Continued)

FOREIGN PATENT DOCUMENTS

CN 203478572 U 3/2014
CN 104748351 A 7/2015

(Continued)

*Primary Examiner* — Harry E Arant
(74) *Attorney, Agent, or Firm* — The Webb Law Firm

(57) ABSTRACT

The present disclosure provides a heat exchanger assembly and an air conditioner. The heat exchanger assembly comprises a first heat exchanger, a second heat exchanger and a third heat exchanger. The second heat exchanger is arranged to be angled relative to the first heat exchanger, the first end of the second heat exchanger is connected with or close to the first end of the first heat exchanger, and the second end of the second heat exchanger is away from the second end of the first heat exchanger. The third heat exchanger is arranged between the first heat exchanger and the second heat exchanger.

11 Claims, 9 Drawing Sheets
(7 of 9 Drawing Sheet(s) Filed in Color)

(56) References Cited

U.S. PATENT DOCUMENTS

| | | | | |
|---|---|---|---|---|
| 2005/0205238 | A1 | 9/2005 | Terada | |
| 2007/0215333 | A1* | 9/2007 | Viklund | F28D 7/0016 165/172 |
| 2011/0120171 | A1* | 5/2011 | Cho | F28B 1/06 62/428 |
| 2015/0053379 | A1* | 2/2015 | Kirchner | B21D 53/06 165/157 |

FOREIGN PATENT DOCUMENTS

| | | | |
|---|---|---|---|
| CN | 108105860 | A | 6/2018 |
| CN | 109341054 | A | 2/2019 |
| EP | 2177854 | A1 | 4/2010 |
| EP | 2330374 | A2 | 6/2011 |
| KR | 100605923 | B1 | 8/2006 |
| WO | 2014091521 | A1 | 6/2014 |

* cited by examiner

HEAT EXCHANGER ASSEMBLY AND AIR CONDITIONER

CROSS-REFERENCE TO RELATED APPLICATIONS

This application is the United States national phase of International Application No. PCT/CN2019/086862 filed May 14, 2019, and claims priority to Chinese Patent Application No. 201810941571.3, filed on Aug. 17, 2018 and titled with "Heat exchanger assembly and Air Conditioner", the disclosures of which are hereby incorporated to the present application in their entirety.

BACKGROUND OF THE INVENTION

Field of the Invention

The present disclosure relates to the technical field of refrigeration equipment, in particular to a heat exchanger assembly and an air conditioner.

Description of Related Art

Currently, air conditioners are more and more used in work and life, and the use of air conditioners is required by lots of spaces that need room temperature adjustment. As spaces are limited, the overall size of air conditioner products required by markets is made smaller and smaller.

However, as the overall size of the air conditioner products is made smaller, a phenomenon of uneven air velocity will occur when the heat exchanger is in use, which will affect the heat exchange efficiency of the heat exchanger and ultimately affect the user experience.

SUMMARY OF THE INVENTION

The present disclosure provides a heat exchanger assembly and an air conditioner to improve the technical problem of uneven air velocity distribution in heat exchange performance after the size of the air conditioner is made smaller in the prior art.

The present disclosure provides a heat exchanger assembly, comprising: a first heat exchanger; a second heat exchanger, wherein the second heat exchanger is arranged to be angled relative to the first heat exchanger, the first end of the second heat exchanger is connected with or is close to the first end of the first heat exchanger, and the second end of the second heat exchanger is away from the second end of the first heat exchanger; and a third exchanger arranged between the first heat exchanger and the second heat exchanger wherein the first end of the third heat exchanger is connected to a point A of the first heat exchanger, the second end of the third heat exchanger is connected to a position B of the second heat exchanger, the position A is located between the first end and the second end of the first heat exchanger, and the position B is located between the first end and the second end of the second heat exchanger.

In some embodiments, the first heat exchanger and the second heat exchanger have the same structure.

In some embodiments, the distance from the position A to the first end of the first heat exchanger is y, the distance from the position A to the second end of the first heat exchanger is x, and $1:7<x:y<1:5$.

In some embodiments, $x:y=1:6$.

In some embodiments, the distance from the position B to the first end of the second heat exchanger is b, the distance from the position B to the second end of the second heat exchanger is a, and $1:7<a:b<1:5$.

In some embodiments, $a:b=1:6$.

In some embodiments, the third heat exchanger consists of a single row of heat exchange tubes.

In some embodiments, the diameter of the single row of heat exchange tubes is 5 mm to 7.94 mm.

In some embodiments, the first heat exchanger and/or the second heat exchanger consist/consists of a plurality of rows of heat exchange tubes.

In some embodiments, the diameter of the four rows of heat exchange tubes is in a range of 7 mm to 9.52 mm.

In some embodiments, the plane D where the third heat exchanger is located is arranged face towards an opening between the second end of the second heat exchanger and the second end of the first heat exchanger.

The present disclosure further provides an air conditioner, comprising a heat exchanger assembly as described above.

In the above-mentioned embodiments, by arranging three heat exchangers in which the second heat exchanger is arranged to be angled relative to the first heat exchanger, and the third heat exchanger is arranged between the first heat exchanger and the second heat exchanger, the surface area of each heat exchanger can be increased on the basis of guaranteeing the air flow communication of the heat exchangers in a limited space, thereby improving the heat exchange performance of the heat exchanger assembly.

BRIEF DESCRIPTION OF THE DRAWINGS

The drawings which form part of the present disclosure are used for providing further understanding of the present disclosure, and the illustrative embodiments of the present disclosure and description thereof are intended for explaining instead of improperly limiting the present disclosure. The patent or application file contains at least one drawing executed in color. Copies of this patent or patent application publication with color drawing(s) will be provided by the Office upon request and payment of the necessary fee. In the drawings.

DETAILED DESCRIPTION OF THE INVENTION

In order to make the objectives, technical solutions and advantages of the present disclosure clearer, the present disclosure will be further described below in detail in conjunction with the embodiments and the drawings. Herein, the illustrative embodiments of the present disclosure and description thereof are intended for explaining instead of limiting the present disclosure.

Figure 1:
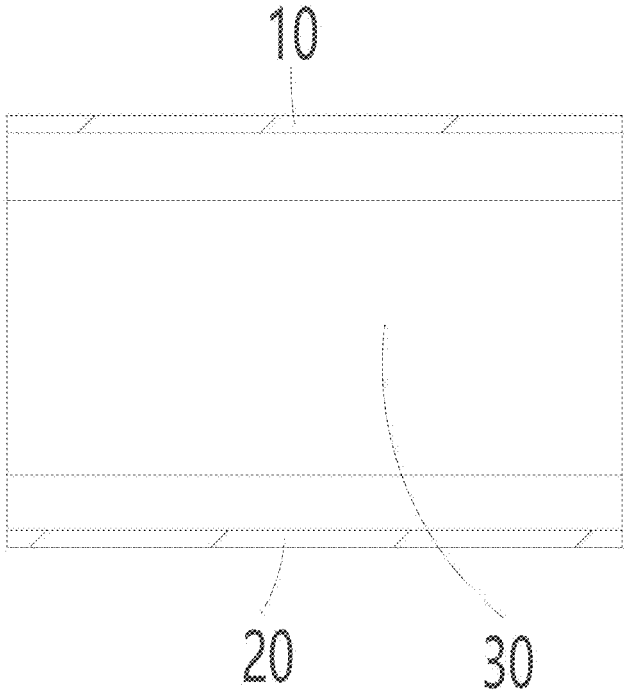
FIG. 1 is a schematic front view of the structure of an embodiment of the heat exchanger assembly according to the present disclosure.
Figure 2:
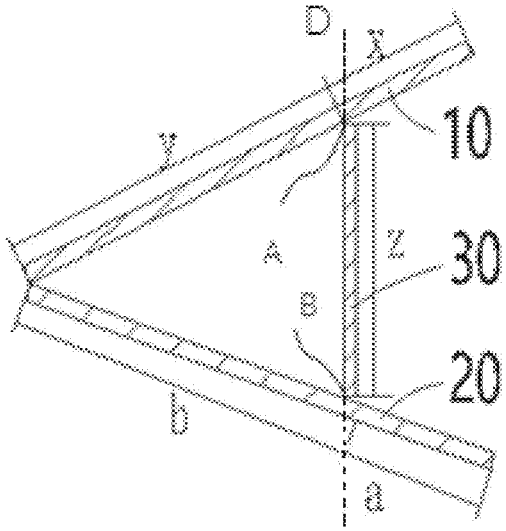
FIG. 2 is a schematic side view of the structure of the heat exchanger assembly of FIG. 1.

FIG. 1 and FIG. 2 illustrate the heat exchanger assembly of the present disclosure, and the heat exchanger assembly comprises a first heat exchanger 10, a second heat exchanger 20 and a third heat exchanger 30. The second heat exchanger 20 is arranged to be angled relative to the first heat exchanger 10, moreover the first end of the second heat exchanger 20 is connected with or close to the first end of the first heat exchanger 10, and the second end of the second heat exchanger 20 is away from the second end of the first heat exchanger 10. The third heat exchanger 30 is arranged between the first heat exchanger 10 and the second heat exchanger 20, the first end of the third heat exchanger 30 is connected to a position A of the first heat exchanger 10, and the second end of the third heat exchanger 30 is connected to a position B of the second heat exchanger 20. A position A is located between the first end and the second end of the first heat exchanger 10, and a position B is located between the first end and the second end of the second heat exchanger 20.

In application of the technical solution of the present disclosure, by arranging three heat exchangers in which the second heat exchanger 20 is arranged to be angled relative to the first heat exchanger 10, and the third heat exchanger 30 is arranged between the first heat exchanger 10 and the second heat exchanger 20, the surface area of each heat exchanger can be increased on the basis of guaranteeing the air flow communication of the heat exchangers in a limited space, thereby guaranteeing the heat exchange performance of the heat exchanger assembly.

It should be noted that, in the technical solution of the present disclosure, the positions A and B are point shaped, line shaped or surface shaped.

Figure 3:
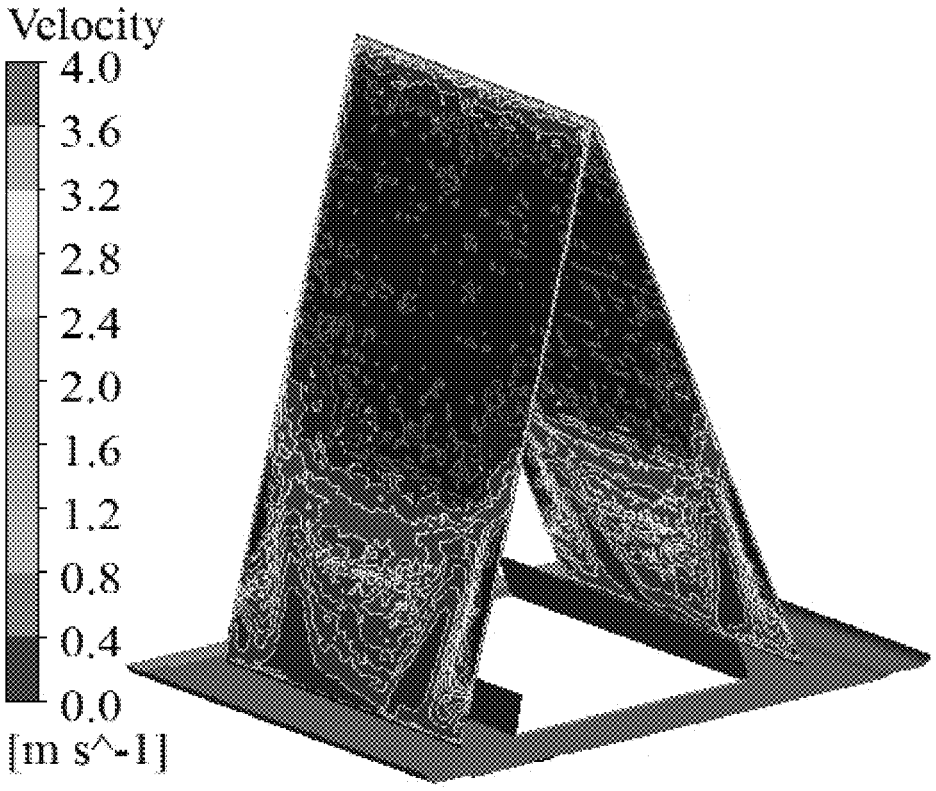
FIG. 3 is a surface air velocity distribution diagram of an existing heat exchanger assembly.
Figure 4:
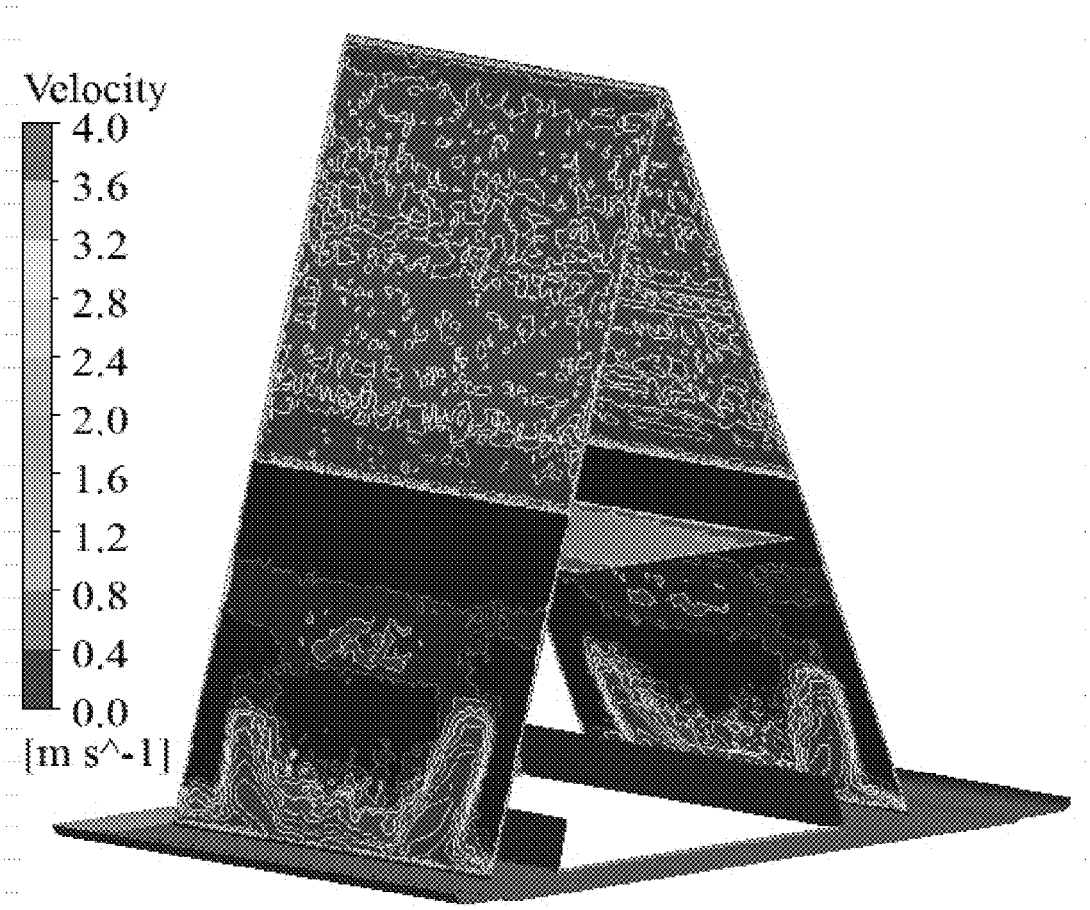
FIG. 4 is a surface air velocity distribution diagram of another embodiment of the heat exchanger assembly according to the present disclosure.

As shown in FIG. 3, the heat exchanger assembly without the third heat exchanger is arranged on a water pan, and it is tested by a test that the surface (namely the bottom of the heat exchanger assembly) of the open side of the heat exchanger assembly has almost no air velocity, and the air velocity is all concentrated at a sharp corner (namely the top of the heat exchanger assembly). Based on this problem, as shown in FIG. 4, in the technical solution of this embodiment, the position A connected to the first end of the third heat exchanger 30 is located between the first end and the second end of the first heat exchanger 10, and the position B connected to the second end of the third heat exchanger 30 is located between the first end and the second end of the second heat exchanger 20. Thus, the surface air velocity of the third heat exchanger 30 can be adjusted in a way of changing the resistance of an air channel, relatively high air velocity can also be distributed at the second ends of the first heat exchanger 10 and the second heat exchanger 20, so that the air velocity is distributed relatively evenly, thereby improving the problem about uneven surface air velocity distribution of the heat exchanger, and increasing the heat exchange amount. In this way, the overall energy efficiency of the heat exchanger assembly can be improved, and the reliability of the heat exchanger assembly is improved.

In some embodiments, the first end of the second heat exchanger 20 and the first end of the first heat exchanger 10 may also be close to each other. Based on this implementation mode, if the third heat exchanger is not provided, the above-mentioned problem that the surface (namely the bottom of the heat exchanger assembly) of the open side has almost no air velocity, and the air velocity is all concentrated at a sharp corner (namely the top of the heat exchanger assembly) also exists. This technical problem can also be improved by adopting the above-mentioned arrangement form of the third heat exchanger 30.

In some embodiments, the plane D where the third heat exchanger 30 is arranged to face towards the opening between the second end of the second heat exchanger 20 and the second end of the first heat exchanger 10. Thus, the third heat exchanger 30 can face towards the air flow blown in via the opening, and the air flow blown in via the opening can be better evened by the third heat exchanger 30, so that the air velocity is distributed more evenly.

In the technical solution of the present disclosure, it is tested by a test that the number of rows of heat exchange tubes constituting the third heat exchanger 30 has a great influence on the overall air velocity distribution of the heat exchanger assembly; when the number of rows of heat exchange tubes is too large, it will hinder the air flow from flowing from the second ends to the first ends of the first heat exchanger 10 and the second heat exchanger 20. As shown in FIG. 4, when the third heat exchanger 30 consists of two rows of heat exchange tubes 301, most of the air velocity stays between the third heat exchanger 30 and the second ends of the first heat exchanger 10 and the second heat exchanger 20, and too little air velocity is distributed between the third heat exchanger 30 and the first ends of the first heat exchanger 10 and the second heat exchanger 20, which would affect the overall energy efficiency of the heat exchanger assembly.

Figure 5:
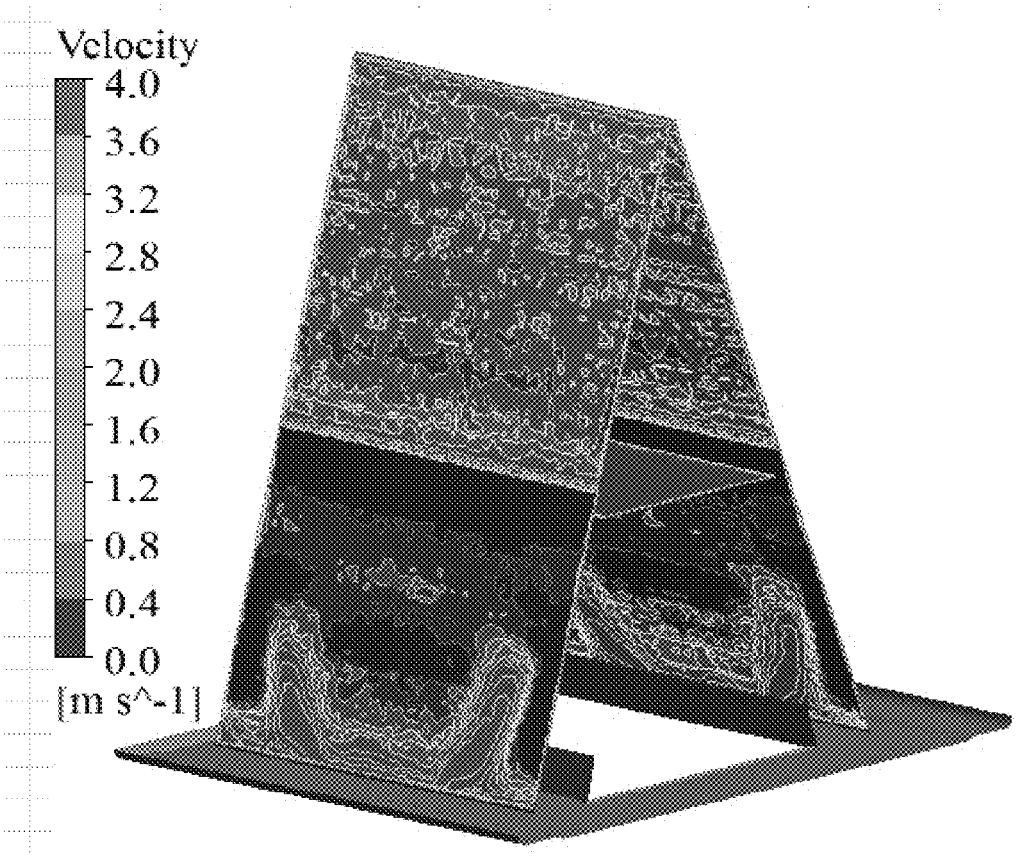
FIG. 5 is a surface air velocity distribution diagram of another embodiment of the heat exchanger assembly according to the present disclosure.

Therefore, in the technical solution of the present disclosure, in some embodiments, the third heat exchanger 30 consists of a single row of heat exchange tubes 301. As shown in FIG. 5, the third heat exchanger 30 consisting of a single row of heat exchange tubes 301 has less influences on the air flow from the second ends to the first ends of the first heat exchanger 10 and the second heat exchanger 20, so that the air velocity is distributed more evenly on the first heat exchanger 10 and the second heat exchanger 20, and the overall energy efficiency of the heat exchanger assembly is guaranteed. Thus, the third heat exchanger 30 can not only increase the heat exchange amount, but can also make the overall surface air velocity distribution of the heat exchanger assembly be distributed more evenly. In the technical solutions of some embodiments, the diameter of the single row of heat exchange tubes is 7 mm.

As shown in FIG. 2, in the technical solution of this embodiment, in some embodiments, the first heat exchanger 10 and the second heat exchanger 20 have the same structure so as to facilitate the manufacturing and installation.

Figure 12:
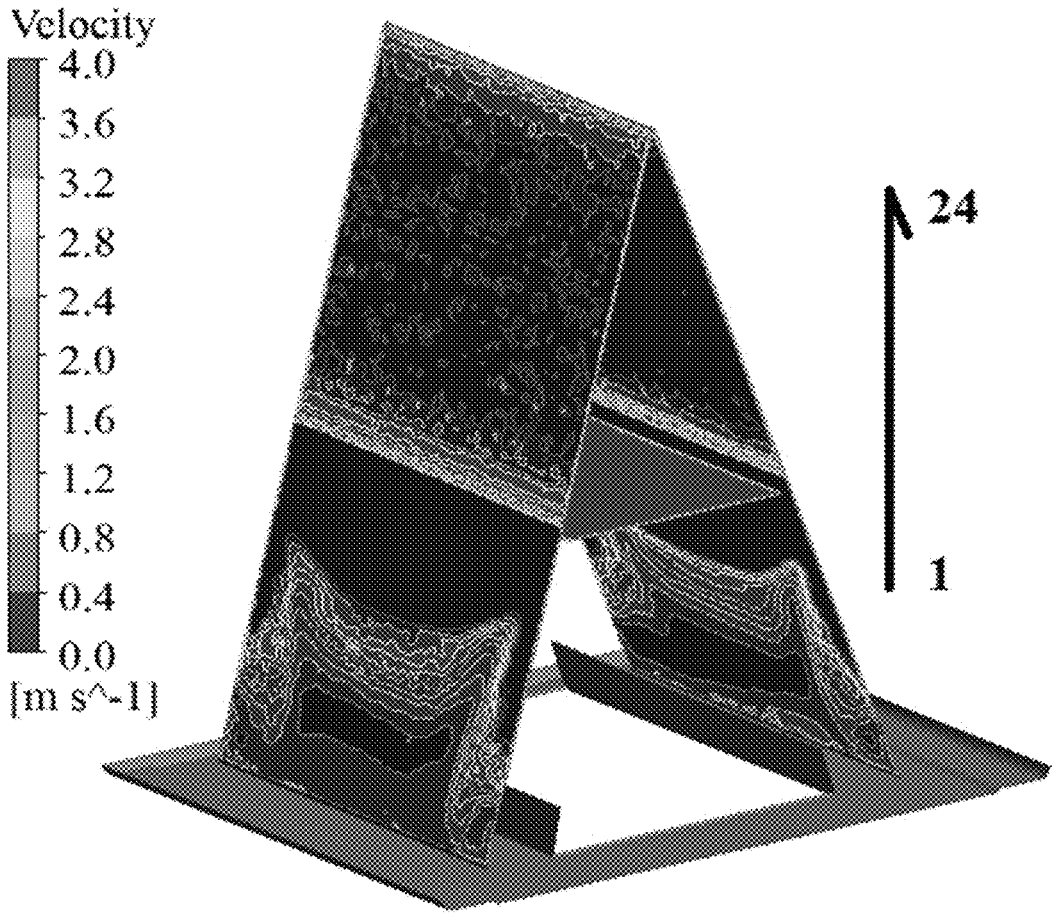
FIG. 12 is a surface air velocity distribution diagram of another embodiment of the heat exchanger assembly according to the present disclosure.
Figure 13:
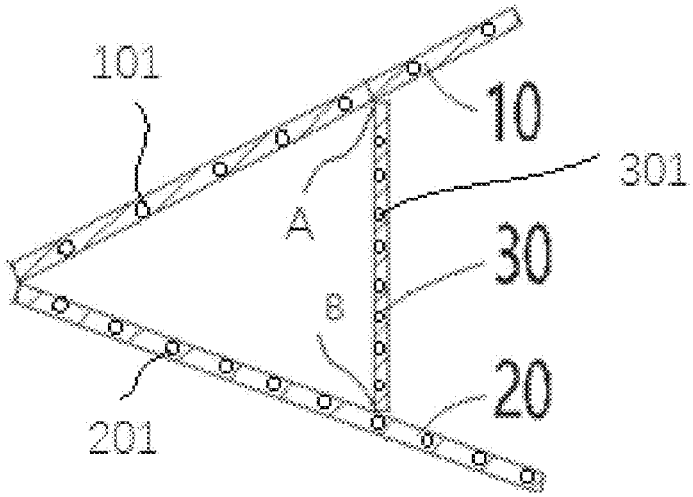
FIG. 13 is a schematic side view of the structure of the heat exchanger assembly of FIG. 1 with one row of heat exchange tubes 101, 201, 301.

In an actual use process, the first heat exchanger 10 and the second heat exchanger 20 are the main units that participate in heat exchange. Therefore, in some embodiments as shown in FIG. 12, the first heat exchanger 10 consist of a plurality of rows of heat exchange tubes 101 and the second heat exchanger 20 consist of a plurality of rows of heat exchange tubes 201, thereby improving the heat exchange capability of the first heat exchanger 10 and the second heat exchanger 20. In some embodiments, the first heat exchanger 10 consists of four rows of heat exchange tubes 101 and the second heat exchanger 20 consist of four rows of heat exchange tubes 201. It is proved by an experimental test that the combination of the first heat exchanger 10 and the second heat exchanger 20 consisting of four rows of heat exchange tubes and the first heat exchanger 10 consisting of a single row of heat exchange tubes 101 can achieve optimized heat exchange performance to distribute the air velocity more evenly, and thus the overall energy efficiency of the heat exchanger assembly is better. In some embodiments, the diameter of the four rows of heat exchange tubes 101 and 201 is 9.52 mm.

In some embodiments, it is also feasible that only the first heat exchanger 10 or the second heat exchanger 20 consists of a plurality of rows of heat exchange tubes.

As shown in FIG. 2, in some embodiments, the distance from the position A to the first end of the first heat exchanger 10 is y, the distance from the position A to the second end of the first heat exchanger 10 is x, and $1:7<x:y<1:5$. In some embodiments, the distance from the position B to the first end of the second heat exchanger 20 is b, the distance from the position B to the second end of the second heat exchanger 20 is a, and $1:7<a:b<1:5$. As shown in FIG. 5, it is proved by an actual test that, by arranging a certain position of the third heat exchanger 30 relative to the first heat exchanger 10 and the second heat exchanger 20 by adopting the above-mentioned ratios, the overall distribution of the air velocity on the heat exchanger assembly can be more even, thereby guaranteeing the overall energy efficiency of the heat exchanger assemblies. In some embodiments, $x:y=1:6$, and $a:b=1:6$. By adopting these ratios, the air velocity can be distributed most evenly on the heat exchanger assembly, so that the overall energy efficiency of the heat exchanger assembly is the highest.

In some embodiments, the length of the third heat exchanger 30 is z, and the size of z is also determined by the angle between the first heat exchanger 10 and the second heat exchanger 20.

In the technical solution of the present disclosure, the heat exchange amount of heat exchanger assemblies of three structures is also measured, and the comparison data is as follows:

| As shown in FIG. 3 | As shown in FIG. 4 | As shown in FIG. 5 |
|---|---|---|
| There is no third heat exchanger arranged in the middle of a common heat exchanger assembly. There are four rows of 9.52 mm heat exchange tubes on the two sides. | It is a heat exchanger assembly formed by combination of a first heat exchanger, a second heat exchanger and a third exchanger. The first heat exchanger and the second heat exchanger adopt four rows of 9.52 mm heat exchange tubes. The third heat exchanger adopts two rows of 7 mm heat exchange tubes. | It is a heat exchanger assembly formed by combination of a first heat exchanger, a second heat exchanger and a third exchanger. The first heat exchanger and the second heat exchanger adopt four rows of 9.52 mm heat exchange tubes. The third heat exchanger adopts a single row of 7 mm heat exchange tubes. |
| Evaporation heat exchange amount W: 16025 | Evaporation heat exchange amount W: 15806 | Evaporation heat exchange amount W: 16721 |

It can be seen that, by adopting the heat exchanger assembly shown in FIG. 3, the air velocity is all concentrated at the sharp corner under a condition that there is no heat exchanger arranged in the middle; by adopting the heat exchanger assembly shown in FIG. 4, after the middle is additionally provided with two rows of heat exchangers, the air velocity at the sharp corner will be reduced rapidly to cause decrease of heat exchange amount of the overall heat exchanger, which is not beneficial for improving the heat exchange efficiency. By adopting the heat exchanger assembly shown in FIG. 5, the air velocity distribution is relatively ideal when the middle is additionally provided with one row of heat exchangers, and it can be seen from the simulation results that the heat exchange amount is increased to a certain extent, and the evaporation heat exchange amount can be maximized.

The technical solution of the present disclosure also provides some other embodiments.

According to conventional air-conditioning knowledge, it can be known that the larger the pipe diameter is, the greater the heat exchange amount will be, that is, when other conditions are the same. The heat exchange amount of four rows of 9.5 2 mm heat exchange tubes is larger than or equal to that of four rows of 7.94 mm heat exchange tubes; the heat exchange amount of four rows of 7.94 mm heat exchange tubes is larger than or equal to that of 4 rows of 7 mm heat exchange tubes; and the heat exchange amount of four rows of 7 mm heat exchange tubes is larger than or equal to that of 4 rows of 5 mm heat exchange tubes. Therefore, when the heat exchange amount of four rows of 7.94 mm heat exchange tubes does not meet the requirements, there is no need to additionally provide a row of heat exchangers in the middle (considering the complexity of the process), it can be directly upgraded to a heat exchanger consisting of four rows of 9.52 mm heat exchange tubes; and when heat exchange amount of four rows of 9.52 mm heat exchange tubes does not meet the requirements, there is only one way of additionally providing a heat exchanger in the middle to increase the overall heat exchange amount because the number of rows cannot be increased.

Figure 6:
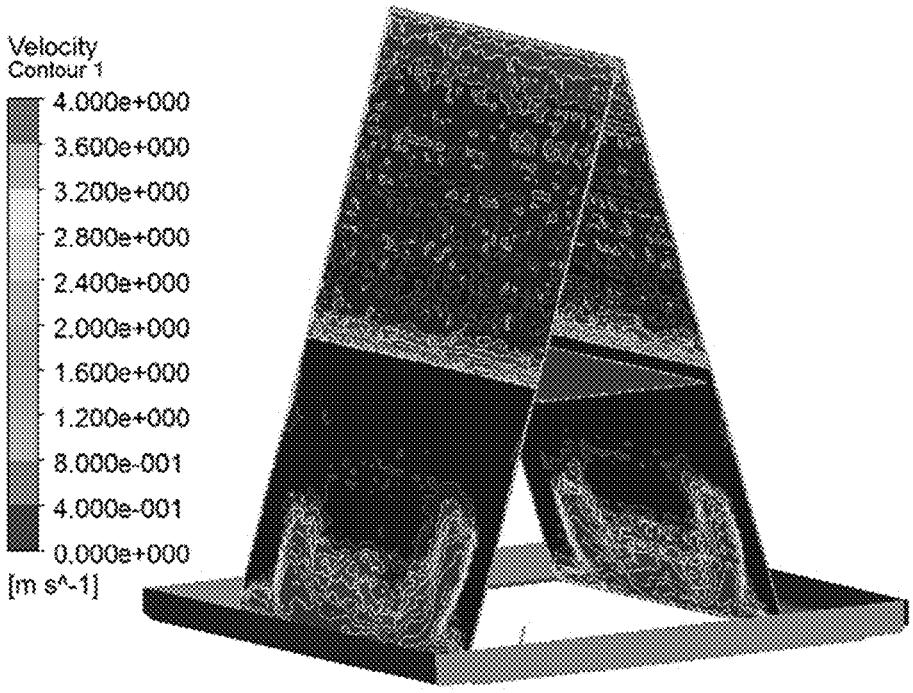
FIG. 6 is a surface air velocity distribution diagram of another embodiment of the heat exchanger assembly according to the present disclosure.

As shown in FIG. 6, in some embodiments, the first heat exchanger and the second heat exchanger adopt four rows of 9.52 mm heat exchange tubes, and the third heat exchanger adopts a single row of 5 mm heat exchange tubes.

Figure 7:
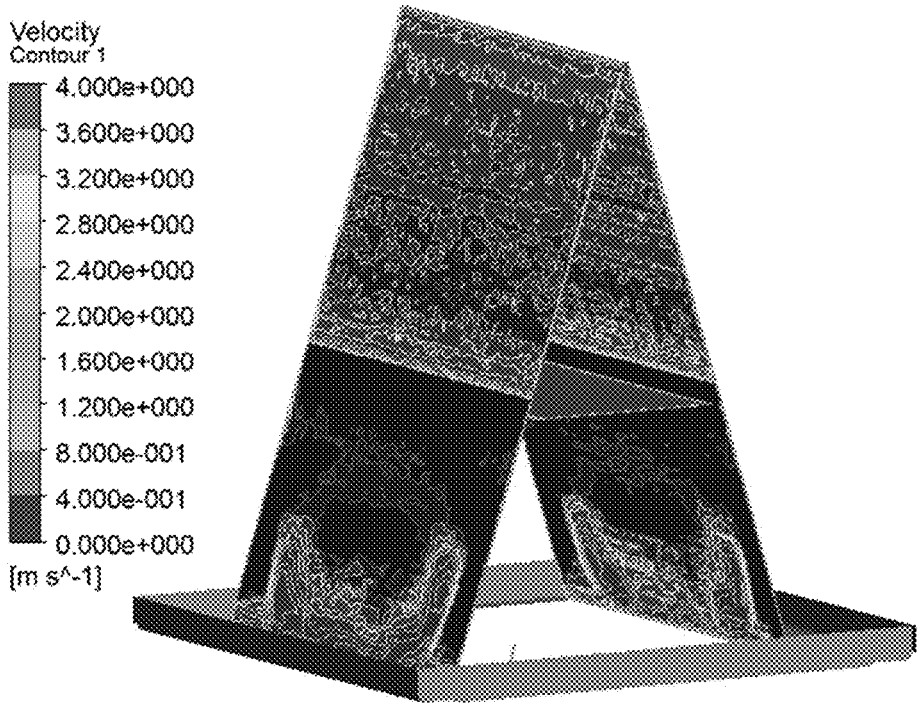
FIG. 7 is a surface air velocity distribution diagram of another embodiment of the heat exchanger assembly according to the present disclosure.

As shown in FIG. 7, in some embodiments, the first heat exchanger and the second heat exchanger adopt four rows of 9.52 mm heat exchange tubes, and the third heat exchanger adopts a single row of 7.94 mm heat exchange tubes.

Figure 8:
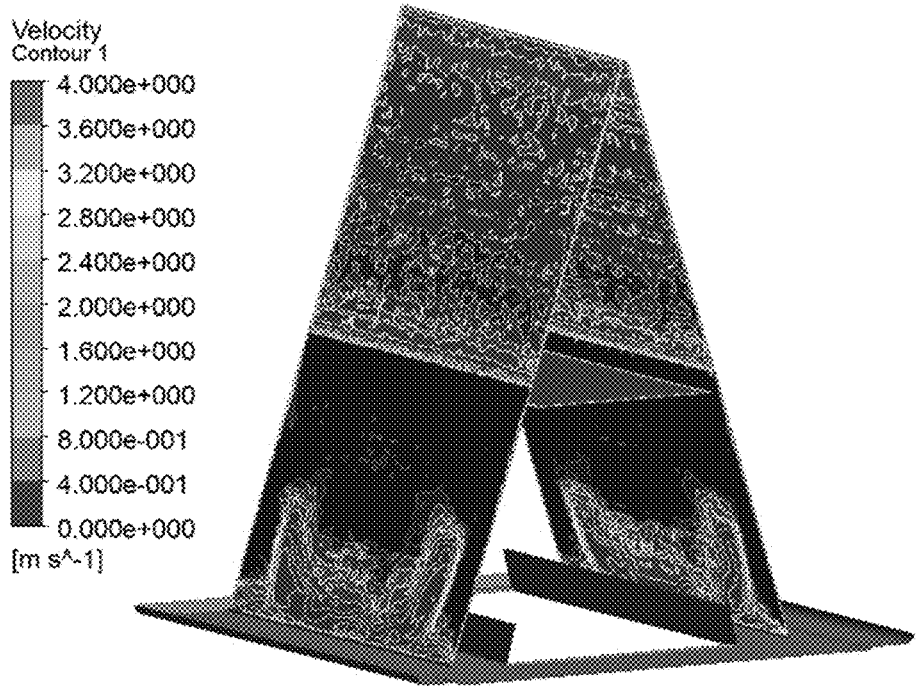
FIG. 8 is a surface air velocity distribution diagram of another embodiment of the heat exchanger assembly according to the present disclosure.

As shown in FIG. 8, in some embodiments, the first heat exchanger and the second heat exchanger adopt four rows of 7.94 mm heat exchange tubes, and the third heat exchanger adopts a single row of 7.94 mm heat exchange tubes.

Figure 9:
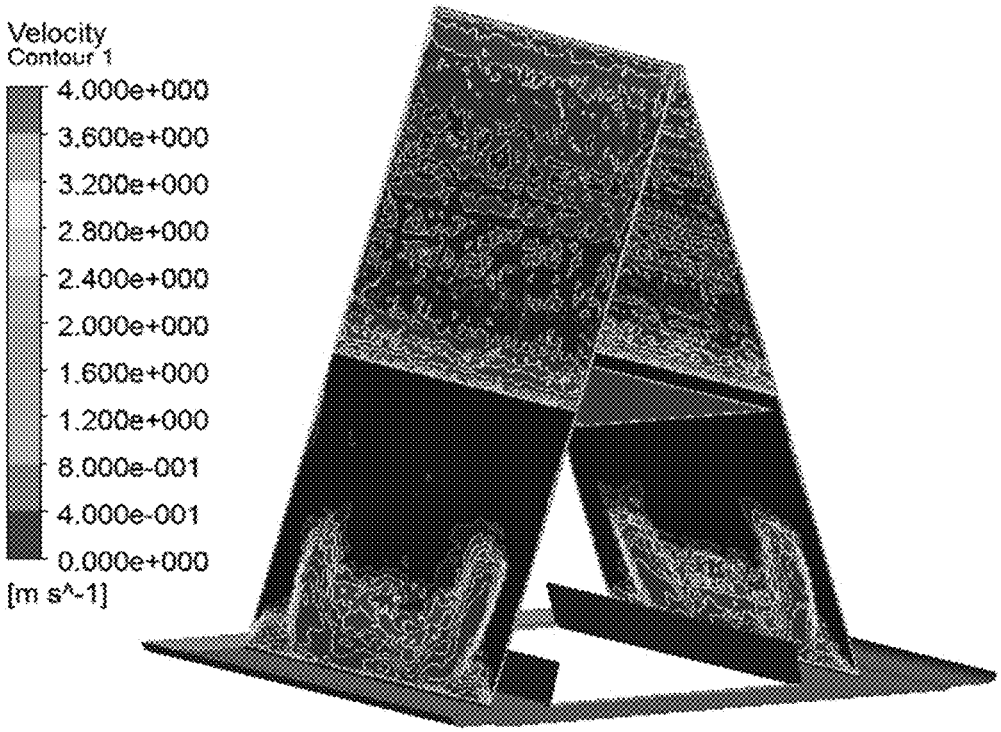
FIG. 9 is a surface air velocity distribution diagram of another embodiment of the heat exchanger assembly according to the present disclosure.

As shown in FIG. 9, in some embodiments, the first heat exchanger and the second heat exchanger adopt four rows of 7.94 mm heat exchange tubes, and the third heat exchanger adopts a single row of 7 mm heat exchange tubes.

Figure 10:
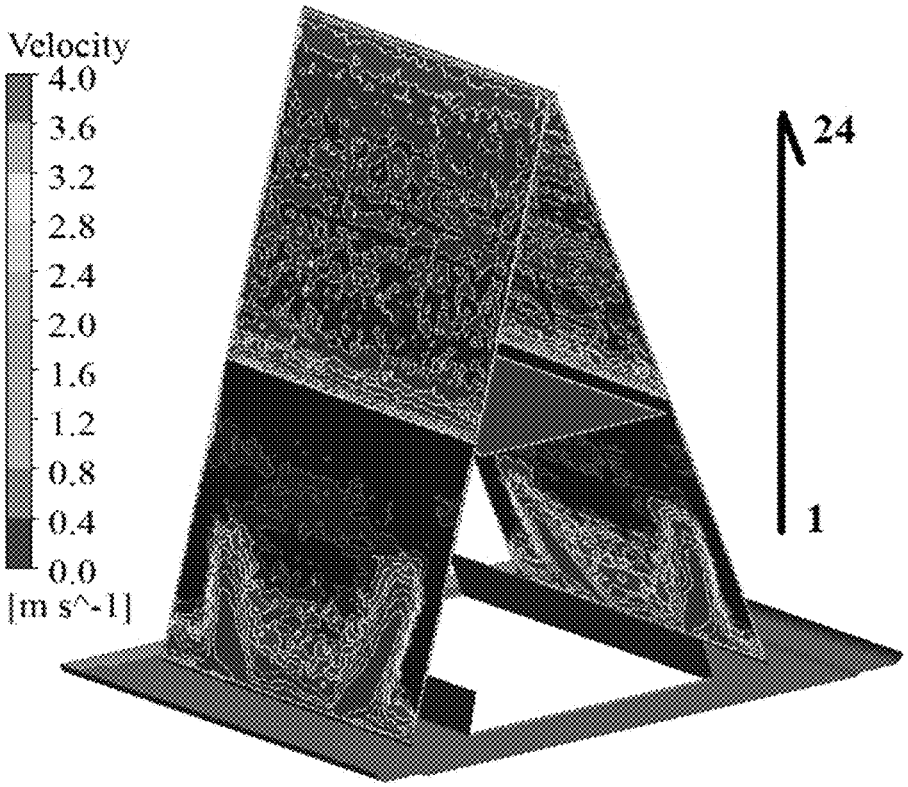
FIG. 10 is a surface air velocity distribution diagram of another embodiment of the heat exchanger assembly according to the present disclosure.

As shown in FIG. 10, in some embodiments, the first heat exchanger and the second heat exchanger adopt four rows of 7.94 mm heat exchange tubes, and the third heat exchanger adopts a single row of 5 mm heat exchange tubes.

Figure 11:
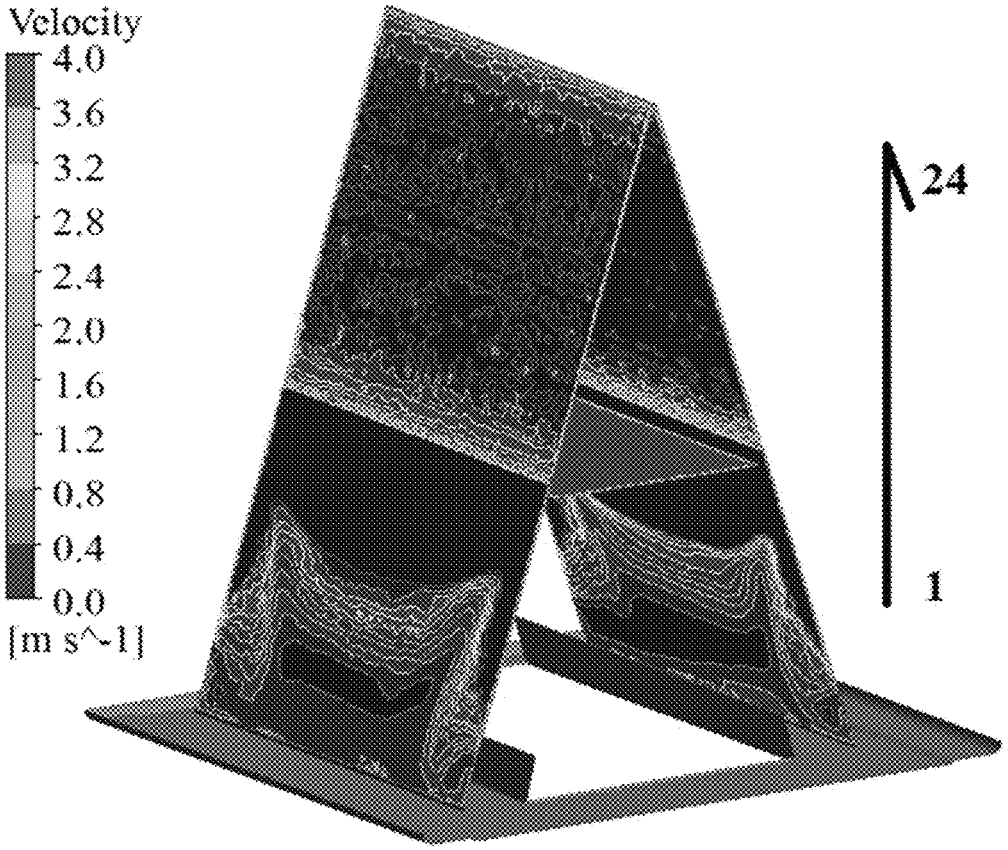
FIG. 11 is a surface air velocity distribution diagram of another embodiment of the heat exchanger assembly according to the present disclosure.

As shown in FIG. 11, in some embodiments, the first heat exchanger and the second heat exchanger adopt four rows of 7 mm heat exchange tubes, and the third heat exchanger adopts a single row of 7 mm heat exchange tubes.

As shown in FIG. 12, in some embodiments, the first heat exchanger and the second heat exchanger adopt four rows of 7 mm heat exchange tubes, and the third heat exchanger adopts a single row of 5 mm heat exchange tubes.

The present disclosure further provides an air conditioner which comprises the heat exchanger assembly described above. By adopting the above-mentioned heat exchanger assembly, the heat exchange performance of the heat exchanger assembly can be improved in a limited space, thereby improving the use performance of the air conditioner.

The foregoing descriptions are only exemplary embodiments of the present disclosure, and are not used to limit the present disclosure. For those skilled in the art, the embodiments of the present disclosure may have various modifications and changes. Any modification, equivalent replacement, improvement, etc., made within the spirit and principles of the present disclosure should be included in the protection scope of the present disclosure.

The invention claimed is:

1. A heat exchanger assembly for an air conditioner, comprising:

a first heat exchanger;

a second heat exchanger, arranged to be angled relative to the first heat exchanger, wherein a first end of the second heat exchanger is connected with or close to a first end of the first heat exchanger, and a second end of the second heat exchanger is away from a second end of the first heat exchanger; and a third heat exchanger, arranged between the first heat exchanger and the second heat exchanger, wherein a first end of the third heat exchanger is connected to a position A of the first heat exchanger, and a second end of the third heat exchanger is connected to a position B of the second heat exchanger, and the position A is located between the first end and the second end of the first heat exchanger, and the position B is located between the first end and the second end of the second heat exchanger, wherein a line normal to a plane D in which the third heat exchanger is located, intersects an opening between the second end of the second heat exchanger and the second end of the first heat exchanger, and further wherein the arrangement of the third heat exchanger between the first heat exchanger and the second heat exchanger includes a distance y from the first end of the third heat exchanger at position A to the first end of the first heat exchanger y, and a distance x from the first end of the third heat exchanger at position A to the second end of the first heat exchanger, and wherein the ration of x to y satisfies the condition that $1:7<x:y<1:5$.

2. The heat exchanger assembly for an air conditioner according to claim 1, wherein the first heat exchanger and the second heat exchanger have the same structure.

3. The heat exchanger assembly for an air conditioner according to claim 1, wherein $x:y=1:6$.

4. The heat exchanger assembly for an air conditioner according to claim 1, wherein a distance from the position B to the first end of the second heat exchanger is b, and a distance from the position B to the second end of the second heat exchanger is a, and $1:7<a:b<1:5$.

5. The heat exchanger assembly for an air conditioner according to claim 4, wherein $a:b=1:6$.

6. The heat exchanger assembly for an air conditioner according to claim 1, wherein the third heat exchanger consists of a single row of a plurality of heat exchange tubes.

7. The heat exchanger assembly for an air conditioner according to claim 6, wherein a diameter of the single row of the plurality of heat exchange tubes is in a range of 5 mm to 7.94 mm.

8. The heat exchanger assembly for an air conditioner according to claim 1, wherein the first heat exchanger and/or the second heat exchanger consist/consists of a plurality of rows of a plurality of heat exchange tubes.

9. The heat exchanger assembly for an air conditioner according to claim 8, wherein the first heat exchanger and/or the second heat exchanger consist/consists of four rows of the plurality of heat exchange tubes.

10. The heat exchanger assembly for an air conditioner according to claim 9, wherein the diameter of each of the four rows of the plurality of heat exchange tubes is in a range of 7 mm to 9.52 mm.

11. An air conditioner, comprising a heat exchanger assembly according to claim 1.

* * * * *